United States Patent [19]

Meyer et al.

[11] 4,225,121

[45] Sep. 30, 1980

[54] ENERGY EFFICIENT HEAT-TREATING FURNACE SYSTEM

[75] Inventors: Robert W. Meyer, Novi; Charles G. Lippert, Pinckney, both of Mich.

[73] Assignee: Holcroft, Livonia, Mich.

[21] Appl. No.: 23,225

[22] Filed: Mar. 23, 1979

[51] Int. Cl.[3] ..... C21D 1/62; C21D 9/00

[52] U.S. Cl. ..... 266/130; 266/252; 266/259

[58] Field of Search ..... 266/130, 132, 133, 249, 266/251, 252, 259

[56] References Cited

U.S. PATENT DOCUMENTS

| | | | |
|---|---|---|---|
| 3,598,381 | 8/1971 | Schwalm | 266/97 |
| 3,662,996 | 5/1922 | Schwalm | 148/6.3 |
| 3,857,553 | 12/1974 | Griffiths | 266/252 |
| 4,093,195 | 6/1978 | Schwalm | 266/251 |
| 4,113,009 | 9/1978 | Meyer | 165/154 |

*Primary Examiner*—T. M. Tufariello

*Attorney, Agent, or Firm*—Herbert E. Messenger; James L. Neal

[57] ABSTRACT

A method and apparatus are disclosed for heat-treating parts in a furnace system which uses a minimum total amount of energy. The self-contained, continuous heat-treating system includes components such as a carburizer, a tempering furnace, and a part cooler. Energy transfer between these and other components operable at different temperatures and/or energy requirements are used to maximize thermal efficiency of the system. Furnace components are provided and interconnected so that combustion air for radiant tube heaters supplying thermal energy to parts in a high temperature furnace such as a carburizer is preheated by exchanging heat in a part cooler and by recuperation of the carburizer exhaust; combustion products from the carburizer supply energy for reheating parts in a lower temperature furnace such as a tempering furnace; the tempering furnace exhaust is used for preheating parts prior to their entry into the carburizer; and energy transferred by the parts to a quench medium is used to heat water for subsequent washing of the parts. In one arrangement of components a tempering furnace is mounted on top of a carburizer as part of a compact multi-level configuration. In another arrangement the components form a single level system with energy transfer features and high thermal efficiencies similar to those of the multi-level system.

13 Claims, 7 Drawing Figures

38

ENERGY EFFICIENT HEAT-TREATING FURNACE SYSTEM

BACKGROUND OF THE INVENTION

This invention relates to heat-treating furnances such as furnace systems for continuous carburizing or forging of metal parts.

Heat-treating furnace systems such as continuous carburizing plants typically include components for performing three primary processing steps: (1) a hardening step wherein the workpieces such as ferrous metal parts are heated under a controlled atmosphere (e.g. a carbon-enriched atmosphere in the case of carburizing); (2) a quench step to rapidly decrease the temperature of the parts; and (3) a reheat step wherein the parts are generally reheated to a lower temperature than employed in the hardening step in order to stress relieve the parts (e.g. tempering). In addition to these primary steps, a heat-treating system usually includes a wash unit in which residual quench media are removed from the parts prior to reheating the parts.

Furnance systems for performing these processing steps use large amounts of energy, and in conventional arrangements of furnance components considerable energy is wasted due to flue losses, wall losses, and losses in transporting parts between components. Part of the energy normally wasted in flue gas exhaust may be recovered by providing recuperators such as are shown in U.S. Pat. No. 4,113,009, "Heat Exchanger Core For Recuperator", isssued to Robert W. Meyer et al. With the exception of recuperators, however, which may be conveniently added to furnace systems as retrofit equipment, energy saving devices for heat-treating furnaces have heretofore been complex, inefficient, and difficult to integrate with existing furnaces. Yet in view of sharply escalating energy costs, furance systems which provide significant further reductions in flue losses and in the other energy looses of heat-treating equipment would be of considerable benefit to furnace technology.

Accordingly, it is an object of the present invention to provide a furnace system for heat-treating parts which is operable at high thermal efficiencies.

It is a more particular object of the invention to provide a furnace system for continuous heat-treating of parts wherein furnace components and energy transfers are arranged to maximize energy usage within the system.

It is another object to provide a thermally efficient heat-treating furnace system which is compact and occupies a relatively small amount of floor area.

It is a further object to provide an energy-efficient method for heat-treating parts.

SUMMARY OF THE INVENTION

A method and apparatus for heat-treating parts are provided wherein furnace components are selected and arranged along with means for transferring energy between components to form a furnace system operable at high thermal efficiencies. In a preferred embodiment of the invention, a furnace system is provided for successive, continuous processing of metal parts in furnace components including a preheater, a first furnace, a quench unit, a washer, a second furnace, and a part cooler. Also included in the system are means for directing the exhaust of the second furnace through the preheater, radiant tube heaters for furnishing thermal energy to heat parts in the first furnace, means for directing preheated air from the part cooler into burners of the radiant tube heaters, means for directing the products of combustion of the radiant tube heaters from the first furnace through the second furnace for heating parts therein, and means for transporting parts successively through the preheater, first furnace, quench unit, washer, second furnace, and cooler.

In a preferred embodiment of the invention, the furnace system is provided with means for exchanging energy between the quench unit and the washer for heating wash water. Also furnished are means for controlling temperatures of the furnaces, such as an auxiliary burner and means for recirculating air as a heating medium within the second furnace. Recuperators are connected to the radiant tube heaters employed for heating parts in the first or high temperature furnace. The recuperators transfer additional heat from the exhaust of the radiant tube heaters to the combustion air following initial preheating thereof in the part cooler.

One particular system of interest is a compact multi-level arrangement wherein a carburizer and a preheater are located on a lower level and a tempering furnace is mounted on top of the carburizer. The upper level of this system also includes a washer and a part cooler. Another embodiment of the invention is a single level furnace system having energy utilization features similar to those of the multi-level system.

DETAILED DESCRIPTION OF PREFERRED EMBODIMENTS

Figure 1:
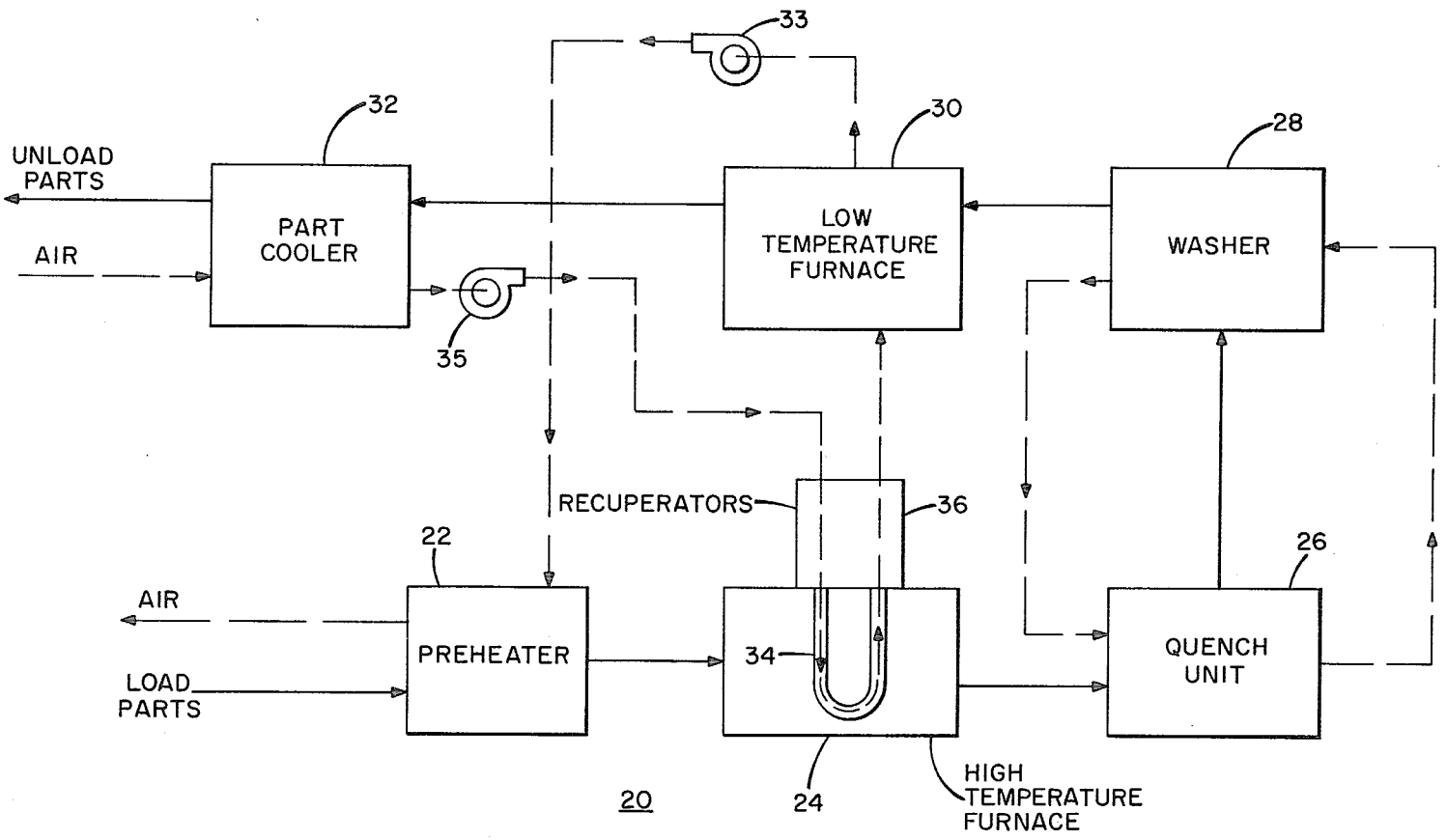
FIG. 1 is a block diagram of the furnace system of the invention showing schematically the flow of parts and flow of energy through the system.

In FIG. 1 there are shown major components of a thermally efficient furnace system 20 for heat-treating workpieces such as metal parts. Solid flow lines in this block diagram indicate the flow of parts through system components during continuous processing of parts, and broken lines indicate the flow of combustion products, air, and other fluids through specified components. As shown in this simplified diagram of the invention, parts to be processed are transported in succession through a preheater 22, a high temperature furnace 24, a quench unit 26, a washer 28, a low temperature furnace 30, and a part cooler 32.

Parts to be processed in the furnace system 20 are first loaded into the preheater 22. The parts are preheated by exchanging heat with the exhaust of the low temperature furnace 30 which is directed through the preheater 22 by means of a blower 33. This preheating step, though not essential to heat-treating processes to which the present invention is directed, permits recovery of a substantial portion of the energy normally wasted due to effluent losses. After passing through the preheater 22, parts are fed into a high temperature furnace 24, typically a furnace for carrying out a process such as carburizing (or carbonitriding) in which parts are heated indirectly by radiant tube heaters 34 in the presence of a carbon-(or carbon/ammonia-) enriched atmosphere. Combustion air for the heaters 34 is preheated in a two-step process wherein air is first drawn through the part cooler 32 by a blower 35 to exchange heat with parts during cooling thereof and then extracts additional heat from the exhaust of the high temperature furnace 24 in passing through a plurality of recuperators 36.

The quench unit 26, which may include a tank of oil or molten salt or any other suitable quench medium, is arranged to receive the parts following their treatment in the high temperature furnace 24 and to quickly lower their temperature. A washer 28 removes oil or salt residues from the parts following the quench. This facilatates further treatment of the parts in the low temperature furnace 30 and the part cooler 32 and minimizes burn-off fumes which would otherwise occur in the low temperature furnace 30. Preferably the water used in the washer 28 is heated by transferring thereto some of the energy normally dissipated in the quench medium instead of separately heating the water. This is achieved by circulating the water through a heat exchanger in the quench unit 26 or, if the temperature differential between the quench medium and the washer 28 precludes this, by circulating a suitable heat exchange medium through the washer 28 and the quench unit 26.

After the parts pass through the washer 28, they are fed to a furnace 30, where they are reheated to a lower temperature than the maximum temperature of the furnace 24 to relieve stresses in the parts (e.g. the furnace 30 may be utilized for tempering or annealing the parts). As is suggested in FIG. 1, a primary source of energy is the exhaust from the furnace 24 from which energy is recovered to successively preheat combustion air in the recuperators 36, heat parts in the furnace 30, and preheat parts in the preheater 22.

The final stage in the furnace system 20 is a part cooler 32, which, like the preheater 22 and the washer 28, does not produce fundamental metallurgical changes in the parts but is desirable since it permits cooling of the parts at a controlled rate and since air drawn through the cooler 32 and ducted to the recuperators 36 allows utilization of thermal energy remaining in the parts after their discharge from the furnace 30 for preheating combustion air for the radiant tube heaters 34.

Figure 2:
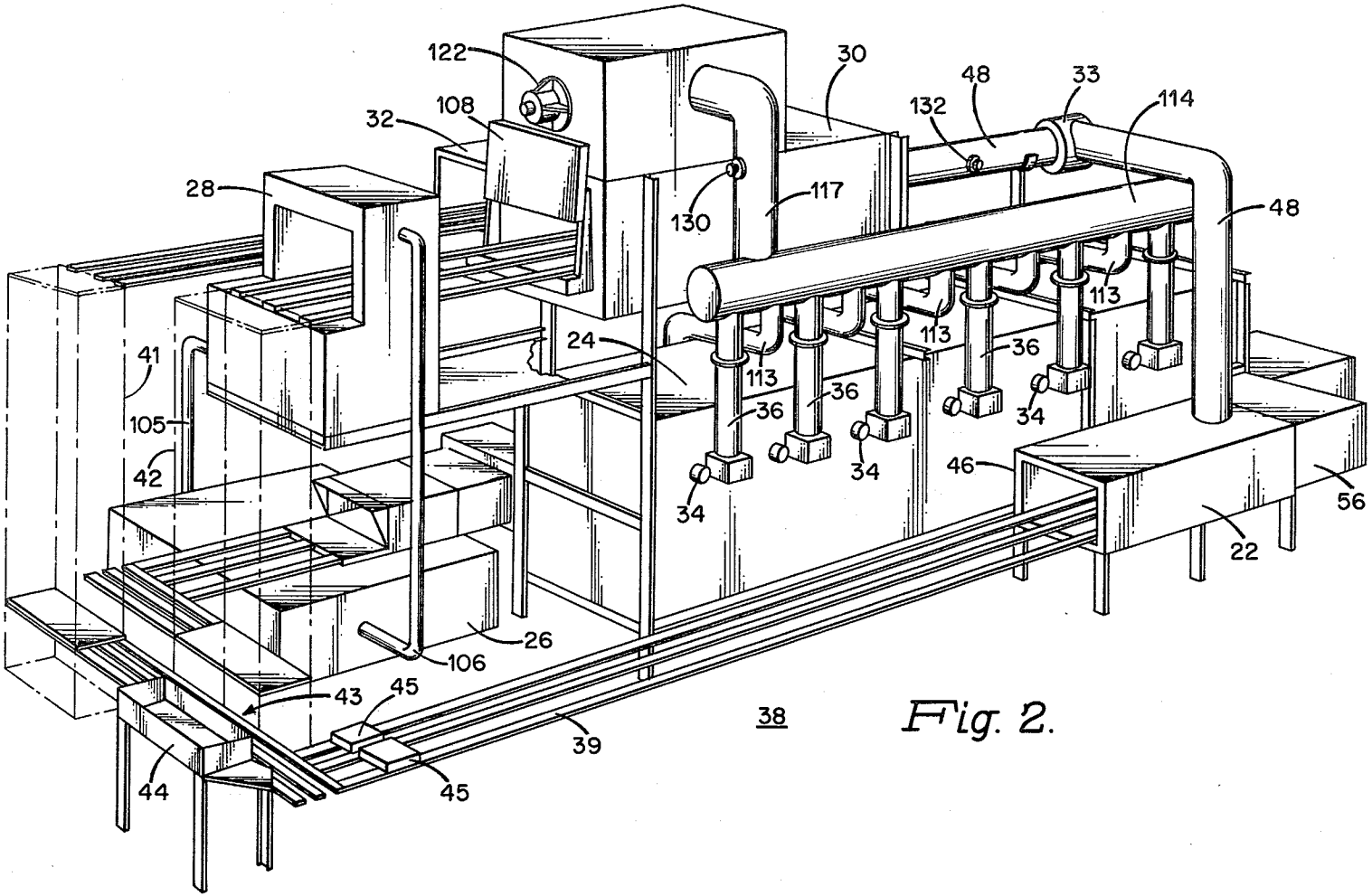
FIG. 2 is a side view in perspective illustrating a multi-level furnace level system according to a preferred embodiment of the invention.

FIG. 2 shows a multi-level carburizing furnace system 38 according to a preferred embodiment of the invention. (In the interest of clarity, there have been omitted from this three-dimensional illustration the ductwork for carrying preheated air from the part cooler 32 to the recuperators 36 and fuel input lines to the recuperators 36. Also, means for transporting parts through the system are illustrated schematically as rails 39). With the exception of the quench unit 26, whose quench tank is preferably located below all other components, the components of the furnace system 38 are arranged on two levels. The preheater 22 and the high temperature furnace 24 are positioned adjacent and parallel to one another on a lower level, while the low temperature furnace 30 is mounted on top of the furnace 24 on an upper level which also contains the washer 28 and the cooler 32. This multi-level arrangement of components, although requiring one or more vertical moving devices such as elevators 41 and 42 shown in phantom at one end of furnace system 38 to move parts between levels, provides a compact furnace configuration.

Figure 3:
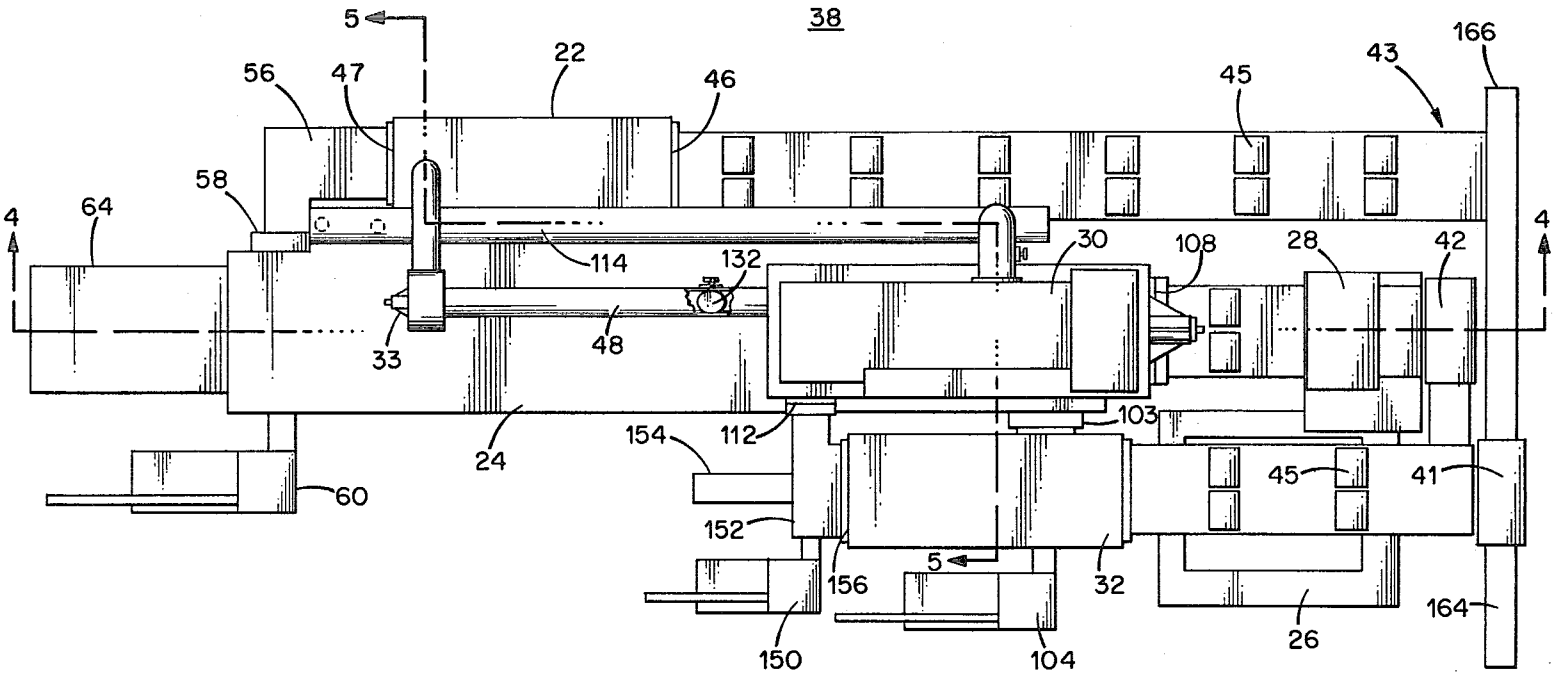
FIG. 3 is a plan view of the multi-level furnace system of FIG. 2.
Figure 4:
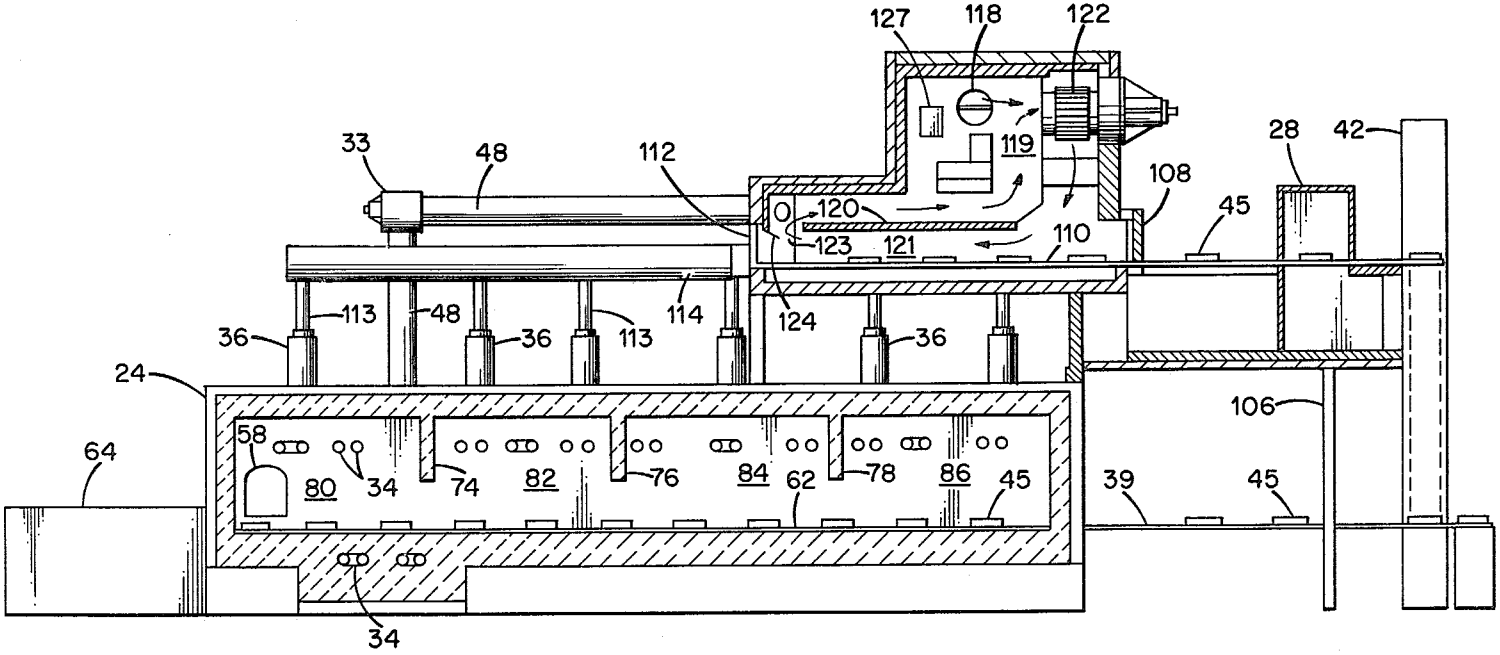
FIG. 4 is a longitudinal cross-section taken along the line 4—4 of FIG. 3.
Figure 5:
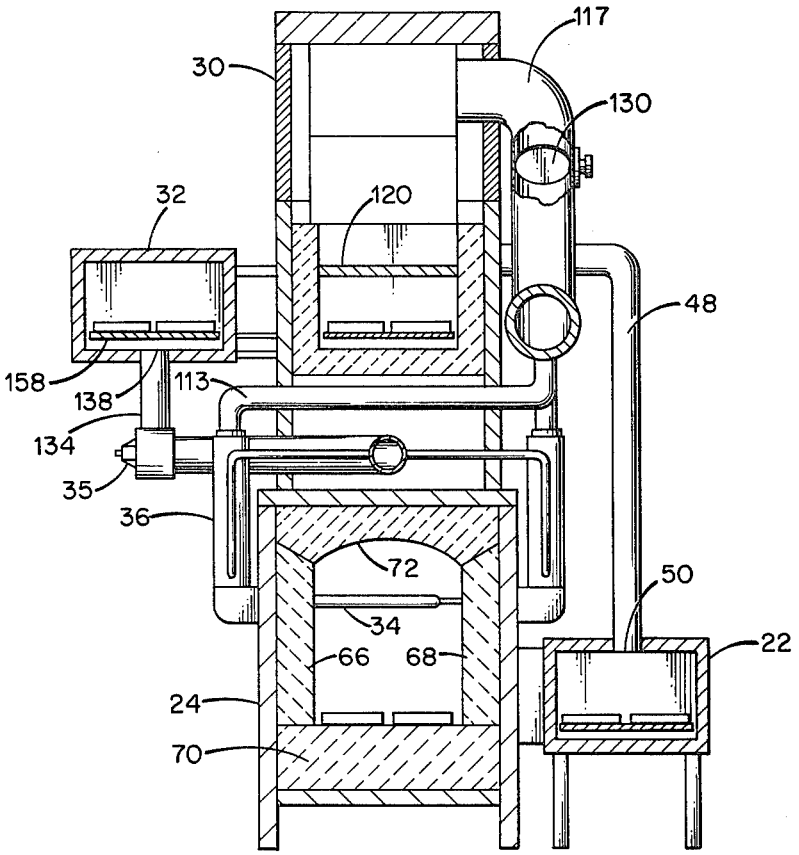
FIG. 5 is a transverse cross-section taken along the line 5—5 of FIG. 3.

Details of the structure and operation of the system illustrated in FIG. 2, shown in more detail in FIGS. 3–5, may be readily understood from a description of its components in the order in which parts are transported therethrough during heat processing. Workpieces such as ferrous metal parts start a processing cycle in a load-/unload area 43 where they are loaded as from a bin 44 into trays 45. The trays 45 are placed on a transport means schematically illustrated as rails 39 in FIG. 2 but which may be a table with rollers, a belt, or any other suitable transport means. The parts are directed along the transport means 39 to the preheater 22, whose part inlet end 46 is open to permit entry of parts and discharge of exhaust gases therefrom. The preheater 22 has an outlet door 47 at the opposite end which opens and closes at desired intervals to discharge parts. Within the preheater 22, parts are preheated by heat exchange with the exhaust from the furnace 30. This exhaust is directed to the preheater 22 through a duct 48, enters the preheater 22 through a gas inlet 50 to circulate over the parts in counterflow to part movement, and then is discharged as the final exhaust of the furnace system 38 through the part inlet end 46. The temperature to which parts are preheated depends on the temperature of the carburizing furnace 24 and the low temperature furnace 30, the rate of flow of parts through the system, and other variables. In one representative heat-treating process wherein the temperature of the carburizing furnace 24 is 1650° F. and that of the low temperature furnace 30 is 400° F., and with a part flow rate of 3000 lbs/hour, parts would be heated from an ambient temperature of about 80° F. to about 350° 1 F. in the preheater 22.

Adjacent to the preheater 22 near the part discharge end thereof is a charge chamber 56 (FIG. 3) where gases which leave the high temperature furnace 24 are burned and the charge chamber 56 is filled with a gaseous atmosphere which prevents scaling or decarburization. To charge trays into the furnace 24, a carburizer inlet door 58 near the charge chamber 56 is opened and a loading mechanism such as a carburizer puller 60 loads at least one tray of parts into the carburizing furnace 24. It should be understood that instead of the puller 60 and the pullers referred to hereinafter, other devices may be used to move parts from one component of the furnace system 38 to another—e.g. a pusher such as pusher 40 shown in FIG. 1 of U.S. Pat. No. 3,662,996 "Multi-Chamber Carburizing Apparatus", issued to D. J. Schwalm and E. C. Bayer, the disclosure of which is incorporated herein by reference.

The furnace 24 includes transport means 62 (FIG. 4) which may be refractory skid rails, a table with rollers, or any other suitable transport system which in cooperation with a pusher 64 permits trays of parts to be transported through the furnace 24. The transport means 62 and the furnace 24 may accommodate a single row or multiple rows of trays, e.g. two rows as indicated in FIG. 3. The interior of the furnace 24 (FIG. 5) is defined by refractory sidewalls 66 and 68, a base 70, and a roof 72. As shown in FIG. 4, arches 74, 76, and 78 separate the interior of the furnace 24 into a heating zone 80, a carburizing zone 82, a diffusing zone 84, and a discharge zone 86. Within each of the zones one or more radiant tube heaters 34 extends transversely between the side walls 66 and 68 above the transport means 62. In one or more zones such as heating zone 80, additional radiant tube heaters 34 may be provided below the transport means 62.

Figure 7:
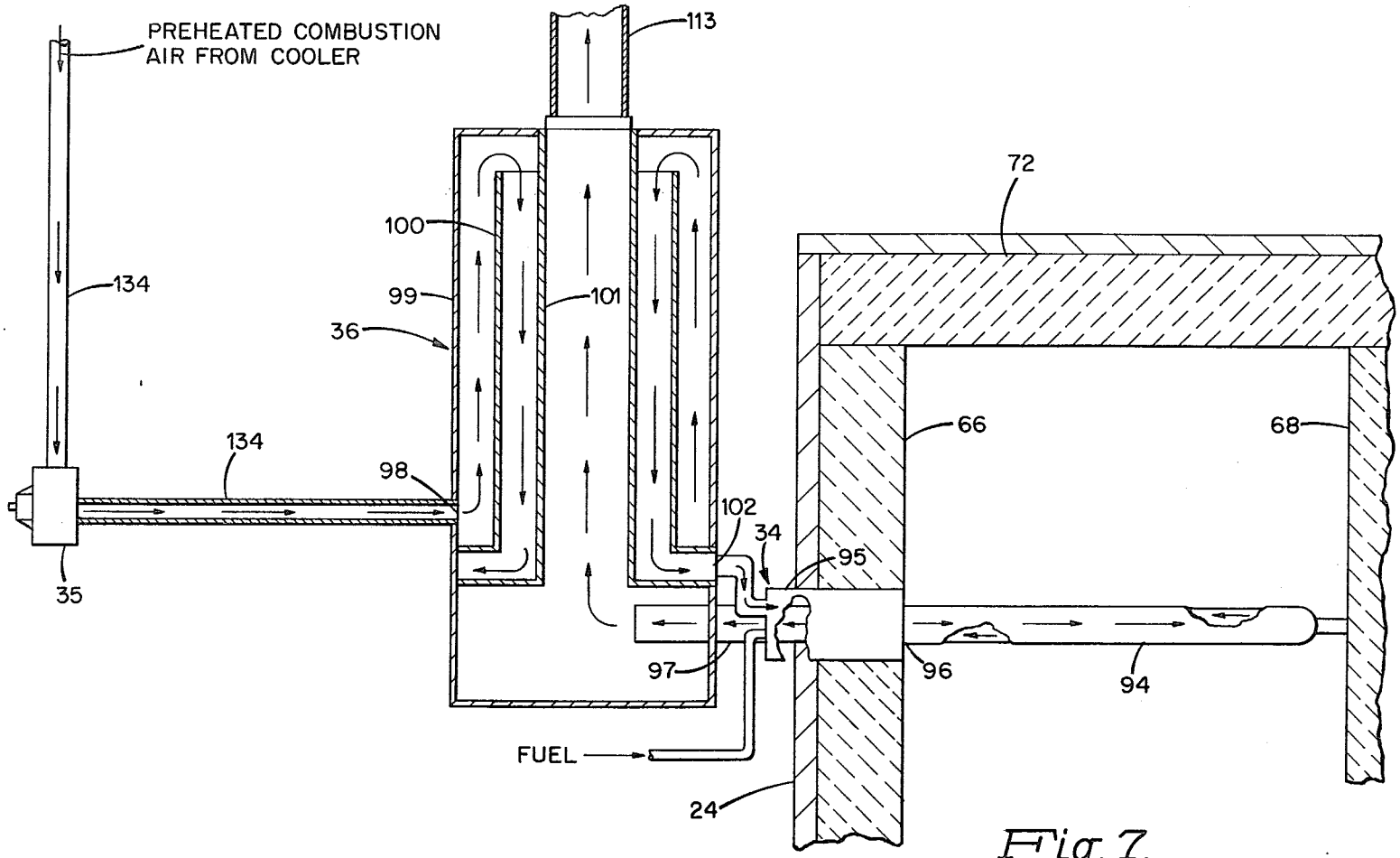
FIG. 7 is a fragmentary transverse cross-section of a high temperature furnace showing details of a recuperator suitable for use in a furnace system of the invention.

As shown in FIG. 7, a typical heater 34 includes a U-shaped radiant tube 94 and a burner 95 which is connected to the inlet 96 of the radiant tube. The outlet 97 of radiant tube 94 is located adjacent to the burner 95 and extends through one of the refractory sidewalls of the furnace 24—e.g. the sidewall 66. During processing of parts, a suitable liquid or gaseous fuel is fed to the burner 95, and the radiant tube 94 radiates energy to heat parts in the furnace 24 to desired temperatures, preferably in the range of 1500° F. and 1800° F.

The furnace 24 also is provided with means (not shown) for supplying an appropriate gas atmosphere to each of the zones 80, 82, 84 and 86 for carburizing the parts, these supply means being well known and forming no part of the present invention. Also included within the furnace 24, but not illustrated, are fans for circulating these gases uniformly around the parts. Suitable fans for this purpose are described in U.S. Pat. No. 4,093,195, "Carburizing Furnace", issued to Donald J. Schwalm, whose disclosure is incorporated herein by reference.

As noted above, the air supplied for combustion in burners such as a burner 95 is preheated initially in the part cooler 32 to recover energy from parts during cooling thereof and a second time in the recuperators 36 to extract energy from the exhaust of the carburizing furnace 24. A recuperator 36 suitable for use in the furnace system 38 is shown in FIG. 7 and comprises three concentric cylinders providing a double pass air flow pattern. Air from the part cooler 32 and the blower 35 enters the recuperator 36 through an inlet 98 near the base of an outer cylinder 99. The air flows upward between the outer cylinder 99 and a middle cylinder 100, down between the middle cylinder 100 and an inner cylinder 101, and then leaves the recuperator 36 through an outlet 102 near the base of the middle cylinder 100 for pressure to the radiant tube heater 34. The inner cylinder 101 serves as a flue for the upward passage of combustion products exhausted from the heater 34 and transfers heat to the combustion air by a combination of radiation and convection. The blower 35 may circulate air to all of the recuperators 36 through appropriate ducting, or may comprise one of a plurality of blowers each circulating air to an individual recuperator.

To permit the discharge of carburized parts from the furnace 24, the sidewall 66 includes an outlet door 103 (FIG. 3) adjacent to the discharge zone 86, and a puller 104 is provided to remove trays from the furnace 24 through the door 103 at appropriate intervals. Parts discharged from the furnace 24 are lowered into and fed through the quench unit 26 by conventional elevator means so that by immersion in a bath of oil, molten salt, or other quench medium the temperature of the parts is rapidly reduced, for example, to a temperature of about 350° F. in the heat-treating process described above wherein the furnace 24 is operable at 1650° F. The parts are then loaded onto an elevator 42 for transport to the upper level of the furnace system 38 and are directed through the washer 28 wherein oil or salt residues are removed from the parts by spraying them with water or water plus detergent. Preferably washing of the parts is performed at a temperature somewhat above ambient, for example at about 180° F., and the wash water is heated to this temperature by circulating it through pipes 105 and 106 connected between the washer 28 and the quench unit 26 and through a suitable heat exchanger (not shown) in contact with the quench medium within the quench unit 26.

In line with the washer 28 on the upper level of the furnace system 38 above the carburizing furnace 24 is a low temperature furnace 30 for reheating parts to a temperature lower than the maximum temperature of the carburizing furnace 24, (e.g. in the range 300° F. to 1400° F.) primarily to relieve stresses in the parts. The furnace 30 has a part inlet door 108 which, when open, admits trays of parts from the washer 28 into the furnace. Also provided are transport means 110 which may be a chain driven rail system or any other suitable conveyor means, and a part outlet door 112 near the end of the furnace 30 opposite the inlet door 58 for permitting discharge of parts.

Energy for heating parts within the furnace 30 is obtained from the exhaust of the radiant tube heaters 34. As is best shown in FIG. 2, the heaters 34 are connected through the recuperators 36 and pipes 113 to a manifold 114 adjacent to one side of the low temperature furnace 30. A duct 117 near one end of the manifold 114 channels exhaust gases from the manifold 114 to the furnace 30 for entry through an inlet 118 into the furnace 30. As shown in FIG. 4, the interior of the furnace 30 is partitioned by a divider 120 into an upper zone 119, which includes features for controlling the temperature and, to a lesser extent, the pressure of the atmosphere within the furnace 30, and a lower zone 121 for reheating parts entering the furnace 30 to a specified temperature and then holding them at this temperature for a desired time interval as they are transported through the lower zone 121 towards the part outlet door 112. A fan or blower 122 is mounted within the upper zone 119 near the end of the furnace 30 above the part inlet door 108 for circulating the furnace atmosphere in a generally clockwise direction as indicated by the arrows in FIG. 4. Flow from the duct 117 is directed through the inlet 118 into the upper zone 119, passes through the fan 122, down into and then along the lower zone 121 in the direction of part flow, and through a passage 123 formed between the divider 120 and a baffle 124 attached to a wall of the furnace 30 near the downstream end thereof. The gas flow then splits so that a portion thereof is discharged from the furnace 30 through the exhaust duct 48 and the remainder passes above and along the divider 120 towards the fan 122 for mixing and recirculation with flow entering the inlet 118.

An auxiliary heater such as a gas-fired burner 127 may also be included within the upper zone 119 on the low pressure side of the fan 122 for supplying additional heat as required for temperature control within the furnace 30. The burner 127 (or suitably placed electric heaters) provides additional energy during start-up and process completion when the burners of the radiant tube heaters 34 are not firing or during steady-state operation to insure precise temperature control within the lower zone 121.

Additional control of the atmosphere within the furnace 30 is provided by a damper-regulated air intake 130 in the duct 117 and a damper-regulated air intake 32 in the exhaust duct 48. A booster blower 33 in the duct 48 directs exhaust from the furnace 30 into and through the preheater 22 wherein energy is extracted from the exhaust to preheat parts prior to a final exhaust of gases from the furnace system 38 through the part inlet end 46 of the preheater.

Adjacent and parallel to the low temperature furnace 30 on the upper level of furnace system 38 is a cooler 32 which is operable to cool parts received from the furnace 30 and to extract thermal energy from the parts to preheat combustion air for the burners of the radiant tube heaters 34. As shown in FIGS. 2 and 5, the part discharge end of the cooler 32 is open to admit air for cooling the parts. A blower 35, within a duct 134 connected to an air outlet 138 near the part inlet end of the cooler 32, draws air through the cooler and directs this preheated air through the duct 134 to the recuperators 36 for further preheating.

To move the parts through the cooler 32 during operation of furnace system 38, a puller 150 removes trays from the furnace 30 through the outlet door 112 into a cooler vestibule 152. At appropriate intervals a pusher 154 then pushes the trays through a cooler inlet door 156 along conveyor means 158 through the cooler 32. Trays move to the end of the conveyor 158, onto an elevator 41 for transport to the lower level, and are directed by a pusher 164 along conveyor means 166 to the load/unload area 43.

Figure 6:
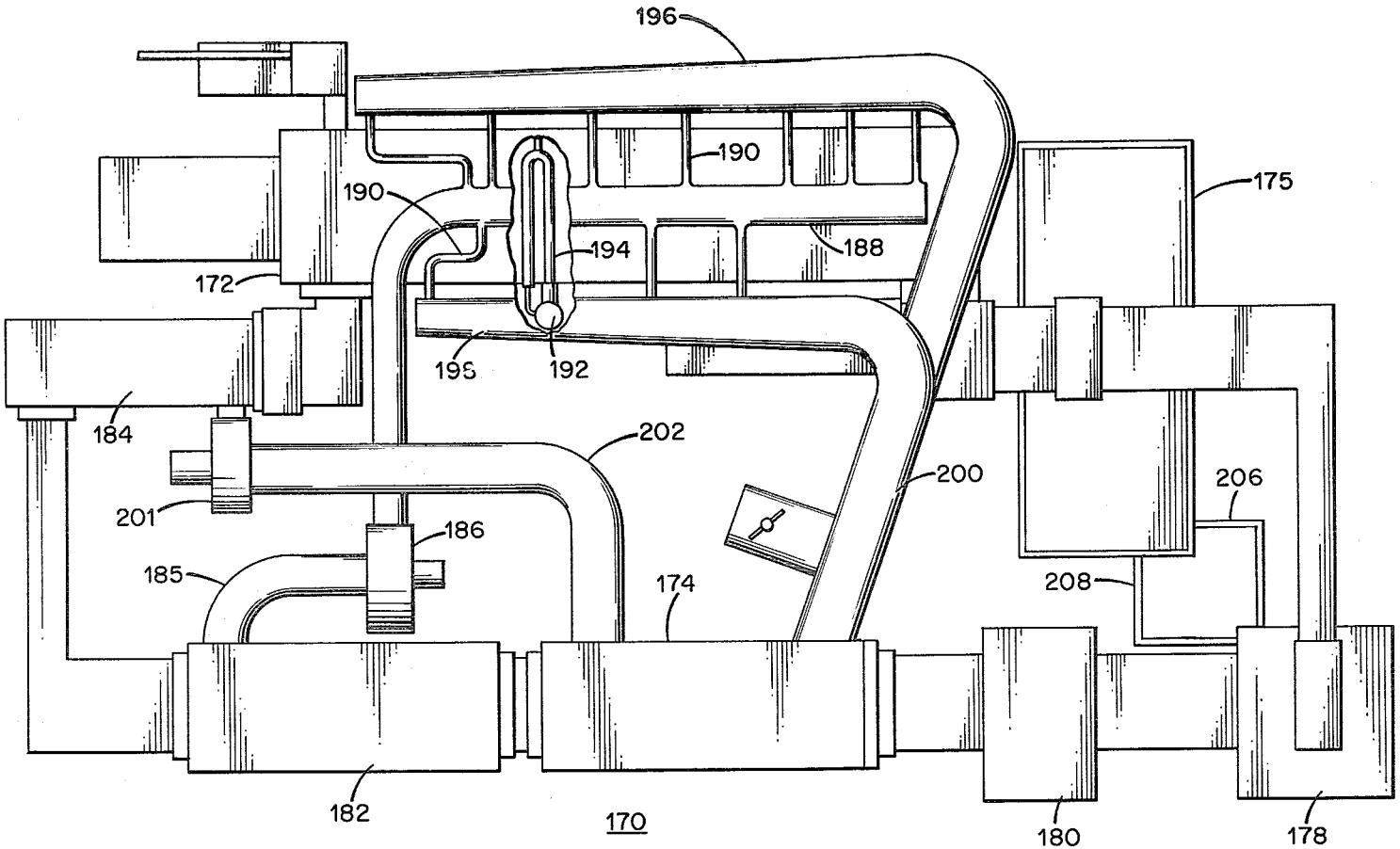
FIG. 6 is a plan view of a single level furnace system according to the invention.

FIG. 6 is a plan view, with portions broken away to expose certain details, of a single level furnace system 170 with components and energy transfer features similar to those of the multi-level system 38 of FIGS. 2–5. In the embodiment of the invention shown in FIG. 6, a carburizing furnace 172 and a tempering furnace 174 are arranged in parallel on the same level as all other components except a quench tank 175 which is preferably located below the common level. This single level arrangement avoids the need for elevators except a conventionally employed elevator mechanism to lower parts into and raise them from the quench medium in the tank 175. The tempering furnace 174 is part of an essentially straight line configuration which also includes a washer 178, a rinse unit 180, and a part cooler 182. A part preheater 184 is also provided between the furnaces 172 and 174.

For efficient energy transfer among the components of the single level furnace system 170, air preheated in the part cooler 182 is drawn therefrom through a duct 185 by a fan or blower 186 and is directed to a manifold 188. Pipes 190 leading from the manifold 188 channel the air to recuperators 192 for additional preheating and then the twice-preheated air is supplied as combustion air to burners connected to U-shaped tubes 194 which radiate heat to the interior of the furnace 172. Dual manifolds 196 and 198 on opposite sides of and above the furnace 172 collect the exhaust of the tubes 194 after passage thereof through the recuperators 192. A duct 200 connected to the manifolds 196 and 198 directs the collected exhaust to the tempering furnace 174 to furnish most or all of the thermal energy needed for tempering or annealing of parts therein. The exhaust of the tempering furnace 174 is drawn by a blower 201 through a duct 202 extending from the discharge end of the furnace 174 and is then directed through the preheater 184 prior to final exhaust from the system 170. Also, water used in washing parts after quenching thereof is heated by circulating it through pipes 206 and 208 connecting the washer 178 to a suitable heat exchanger in contact with the quench medium within the quench tank 175.

While certain preferred embodiments of the invention have been shown and described, it will be apparent that various changes may be made without departing from the scope and spirit of the invention, and thus other embodiments are within the following claims.

What is claimed is:

1. A furnace system for heat-treating parts comprising:

a first furnace;

a preheater for heating parts prior to entry of the parts into said first furnace;

heater means for heating parts to a predetermined temperature in said first furnace;

a quench unit connected to the part discharge end of said first furnace, said quench unit containing a quench medium for rapidly lowering the temperature of parts received from said first furnace;

a second furnace for heating parts to a lower temperature than said predetermined temperature following passage of said parts through said quench unit;

a cooler attached to the part discharge end of said second furnace for cooling parts received from said second furnace and heating air for use as combustion air in said heater means;

means for directing said heated air from said cooler to said heater means;

means for directing the products of combustion of said heater means from said first furnace through said second furnace for heating of parts in said second furnace;

means for directing the exhaust of said second furnace through said preheater for heating of parts therein; and transport means for moving said parts successively through said preheater, said first furnace, said quench unit, said second furnace, and said cooler.

2. A furnace system as in claim 1 further including:

a washer containing a cleansing fluid for washing parts subsequent to passage of said parts through said quench unit;

means for transporting parts from said quench unit through said washer and to said second furnace; and means for circulating said cleansing fluid between said washer and said quench unit and for extracting energy from said quench medium to heat said fluid.

3. A furnace system as in claim 2 wherein said heater means comprises a plurality of radiant tube heaters each including a burner and a U-shaped tube connected to said burner and extending transversely across said first furnace, and said system further includes recuperator means connected between said cooler and said radiant tube heaters for permitting heat exchange between the products of combustion of said radiant tube heaters and the heated air from said cooler.

4. A furnace system as in claim 3 wherein said recuperator means comprises a plurality of cylindrical recuperators, each recuperator connected to at least one of said radiant tube heaters and including:

an inner cylindrical flue in fluid communication with the outlet end of its associated radiant tube heater for receiving and passing therethrough the products of combustion exhausted from said radiant tube heater; and wall means surrounding said flue and having an inlet for receiving heated air from said cooler and an outlet for discharging air to the inlet end of the burner of its associated radiant tube heater for use therein as combustion air, said wall means defining a passage for flow of said heated air from said inlet to said outlet such that thermal energy from said combustion products passing through said flue is transferred to and further increases the temperature of said heated air in said passage.

5. A furnace system as in claim 3 wherein said first furnace comprises a carburizing furnace having a heating zone, a carburization zone, a diffusion zone, and a discharge zone, and said second furnace comprises a tempering furnace.

6. A furnace system as in claim 3 wherein said means for directing the products of combustion from said radiant tube heaters through said second furnace includes a manifold for collecting said products of combustion and a duct connected between said manifold and the upper portion of said second furnace.

7. A furnace system as in claim 6 wherein said second furnace includes divider means in the interior thereof substantially separating said furnace into a lower zone for heating parts transported therethrough and an upper zone having an inlet for admitting the products of combustion from said radiant tube heaters to define the atmosphere of said second furnace and also having fan means for circulating said atmosphere through the lower zone of said furnace.

8. A furnace system as in claim 7 wherein said second furnace includes an outlet for discharging a first portion of said atmosphere after said atmosphere passes through said lower zone and a baffle attached to a wall of said furnace near the part discharge end thereof and defining with said divider means a passage for admitting a second portion of said atmosphere to the upper zone for recirculation by said fan means to said lower zone.

9. A furnace system as in claim 8 wherein said second furnace includes an auxiliary heater for supplying additional thermal energy to said second furnace.

10. A furnace system as in claim 9 wherein said auxiliary heater comprises a gas burner mounted in said upper zone of said second furnace.

11. A furnace system as in claim 3 wherein said first furnace is positioned on a lower level and said second furnace is mounted on an upper level above and parallel to said first furnace.

12. A furnace system as in claim 11 wherein said preheater is positioned on said lower level and said washer and said cooler are positioned on said upper level.

13. A furnace system for continuous heat-treating of metal parts comprising:

a carburizing furnace;

a plurality of radiant tube heaters extending transversely across said carburizing furnace for heating parts therein to a temperature in the range 1500° F. to 1800° F.;

a preheater connected to the part inlet end of said carburizing furnace for heating parts prior to entry of the parts into said carburizing furnace;

a quench unit connected to the part discharge end of said carburizing furnace and containing oil or molten salt for quenching parts received from said carburizing furnace;

a washer for cleaning parts subsequent to their passage through said quench unit;

a temperature furnace for receiving parts from said quench unit and reheating said parts to a temperature in the range 300° F. to 1400° F.;

a cooler attached to said tempering furnace for cooling parts received from said tempering furnace and heating air for said burners;

a plurality of recuperators each connected between said cooler and one of said radiant tube heaters for transferring additional thermal energy to heated air from said cooler prior to use thereof as combustion air in said burners;

means for transporting parts successively through said preheater, carburizing furnace, quench unit, washer, tempering furnace, and cooler;

means for directing heated air from said cooler to said recuperators;

means for directing the products of combustion of said radiant tube heaters from said carburizing furnace through said tempering furnace for reheating of parts in said tempering furnace;

means for directing the exhaust of said tempering furnace through said preheater for heating of parts therein; and means for circulating wash water between said washer and said quench unit for heating the water by extraction of energy from the oil or molten salt in said quench unit.

* * * * *